US006034640A

United States Patent [19]

Oida et al.

[11] Patent Number: 6,034,640

[45] Date of Patent: Mar. 7, 2000

[54] ANTENNA DEVICE

[75] Inventors: Toshifumi Oida, Omihachiman; Teruhisa Tsuru, Kameoka; Yoshihiro Yoshimoto, Shiga-ken; Harufumi Mandai, Takatsuki, all of Japan

[73] Assignee: Murata Manufacturing Co., Ltd., Japan

[21] Appl. No.: 09/053,550

[22] Filed: Apr. 1, 1998

[30] Foreign Application Priority Data

Apr. 1, 1997 [JP] Japan ..... 9-082859

[51] Int. Cl.[7] ..... H01Q 1/24

[52] U.S. Cl. ..... 343/722; 343/700 MS; 343/829

[58] Field of Search ..... 343/722, 700 MS, 343/829, 830

[56] References Cited

U.S. PATENT DOCUMENTS 4,475,108 10/1984 Moser ..... 343/700 MS

FOREIGN PATENT DOCUMENTS 0 687 030 A1 10/1994 European Pat. Off. .
0687030 12/1995 European Pat. Off. .
0 764 999 A1 9/1996 European Pat. Off. .
0764999 3/1997 European Pat. Off. .
0795922 9/1997 European Pat. Off. .
2553586 4/1985 France .
2 147 147 9/1984 United Kingdom .
2147147 9/1984 United Kingdom .

OTHER PUBLICATIONS

Patent Abstracts of Japan vol. 5, No. 137, Aug. 29, 1981 Japan 56 073904 A (Matsushita) Jun. 19, 1981 Abstract.

*Primary Examiner*—Don Wong
*Assistant Examiner*—James Clinger
*Attorney, Agent, or Firm*—Ostrolenk, Faber, Gerb & Soffen, LLP

[57] ABSTRACT

The invention provides an antenna device, comprising: an antenna body including a conductor, an equivalent circuit of said conductor comprising an inductive component and a resistive component in a series connection, wherein a frequency adjusting circuit including at least a parallel circuit of a switching element and a passive element is connected to said conductor of said antenna body. The antenna body is connected in series with said frequency adjusting circuit.

The invention enable to provide a compact antenna device for use in a mobile communication apparatus that performs transmission and reception on frequencies in a wide range.

10 Claims, 8 Drawing Sheets

FIG. 15 *PRIOR ART*

ANTENNA DEVICE

BACKGROUND OF THE INVENTION

1. Field of the Invention

The present invention relates to an antenna device and, more particularly, to an antenna device comprising an antenna body including a conductor, an equivalent circuit of said conductor comprising an inductive component and a resistive component in a series connection. The antenna device is used for a mobile communication apparatus such as a mobile telephone and a pager.

2. Related Art of the Invention

Generally, bandwidth x gain=constant if the volume of an antenna remains constant, and an antenna having a increased volume or a plurality of antennas having different resonant frequencies are used to expand the bandwidth with the gain maintained so that the antenna works with a mobile communication apparatus which requires a wide band for accommodating transmission and reception frequencies therewithin. The former case is represented by a 10 cm whip antenna, 5/8 times the wavelength of a reception frequency or the wavelength of a transmission frequency in the system of PDC (Personal Digital Cellular) 800, one type of portable telephone, having a reception frequency of about 818 MHz, a transmission frequency of about 948 MHz, a bandwidth of 16 MHz for each of transmission and reception. The latter case is represented by a receiving loop antenna 61 and a transmitting inverted F antenna 62, both, mounted on a board 63 as shown in FIG. 15 in a duplex pager system having a reception frequency of about 940 MHz, a transmission frequency of about 901.5 MHz and a bandwidth of 1 MHz for each of transmission and reception.

However, if the bandwidth of the above conventional antenna is widened to transmit and receive on frequencies in a wide range for use in a mobile communication apparatus, the volume of the antenna has to be increased, a plurality of antennas having different resonant frequencies have to be mounted on a circuit board, and as a result, the antenna occupies a wide area in the mobile communication apparatus. This presents difficulty implementing compact design in the mobile communication apparatus.

SUMMERY OF THE INVENTION

The present invention has been developed to overcome such a problem, and provides a compact antenna device for use in a mobile communication apparatus capable of transmission and reception on frequencies in a wide range.

The present invention provides an antenna device of the above mentioned kind, wherein a frequency adjusting circuit including at least a parallel circuit of a switching element and a passive element is connected to said conductor of said antenna body. The antenna body is preferably connected in series with said frequency adjusting circuit.

Since the parallel circuit constituting the switching element and the passive element is connected, preferably in series with the antenna body, the capacitive component or inductive component of the antenna device is changed by turning on or off the switching element.

The resonant frequency of the antenna device is thus changed without changing the gain of the antenna device. As a result, even the antenna device itself has a narrow bandwidth, it works in a wide range of frequency, and is thus used in the mobile communication apparatus performing transmission and reception on frequencies in a wide range.

Since the antenna body and the parallel circuit constituting the switching element and the passive element can be mounted on the circuit board, a compact design is implemented in the antenna device. The antenna device can thus be mounted on a portable mobile communication apparatus performing transmission and reception on frequencies in a wide range.

The compactly designed antenna device allows itself to be housed in the apparatus body of the mobile communication apparatus, thereby eliminating any projections from the mobile communication apparatus.

In the above antenna device, said passive element may be a capacitance element and/or an inductance element.

When the passive element is a capacitance element, since the parallel circuit constituting the switching element and the capacitance element is connected in series with the conductor of the antenna body, the capacitive component of the antenna device is changed by turning on or off the switching element. The resonant frequency with the switching element turned on is set to be lower and the resonant frequency with the switching element turned off is set to be higher.

When the passive element is a inductance element, since the parallel circuit constituting of the switching element and the inductance element is connected in series with the antenna body, the inductive component of the antenna device is changed by turning on or off the switching element. The resonant frequency with the switching element turned on is set to be higher and the resonant frequency with the switching element turned off is set to be lower.

In the above antenna device, said frequency adjusting circuit may be connected in series between said conductor of said antenna body and a high-frequency circuit.

By this structure, the one end of the conductor of the antenna body is grounded through the capacitors for adjusting the input impedance of the antenna device, and the other end of the antenna body is left open, and the antenna device has thus a structure equivalent to a mono-pole antenna. The antenna device has a widened bandwidth, and works in a wider frequency range, and is thus used in the mobile communication apparatus performing transmission and reception on frequencies in a wider range.

In the above antenna device, said antenna body may be connected in series between said frequency adjusting circuit and a high-frequency circuit.

By this structure, the one end of the conductor of the antenna body is grounded, and the other end of the antenna body is grounded through the frequency adjusting circuit, and the antenna device has thus a structure equivalent to a loop antenna. The antenna device is therefore affected less by the environment surrounding it, and the antenna characteristics such as gain and directivity are improved.

In the above antenna device, another capacitance element for adjusting the input impedance of the antenna device may be connected in series with said parallel circuit of said switching element and said passive element.

By this structure, the input impedance of the antenna device can be adjusted by adjusting the capacitance value of the capacitor.

Even if the input impedance of the antenna device deviates from the characteristic impedance of the radio frequency circuit of the mobile communication apparatus to which the antenna device is mounted, the input impedance will be adjusted by turning on and off the switching element.

In the above antenna device, the antenna body may be a chip antenna which comprises a base made of at least one of a dielectric material and a magnetic material, at least one said conductor formed at least on an external surface of said base or within said base, and a feeding terminal, which is provided on the surface of said base and to which one end of said conductor is connected.

By this structure, the antenna body having the base manufactured of at least one of the dielectric material and the magnetic material slows velocity of propagation, shortening wavelength, and let $\epsilon$ represent dielectric constant of the base, effective transmission line length is multiplied by $\epsilon^{1/2}$, thereby becoming longer than the effective transmission line length of conventional wire-like antenna. The area of current distribution is therefore expanded, increasing quantity of radiated radio wave and enhancing gain of the antenna device.

In the above antenna device, said switching element constituting said parallel circuit is mounted on said antenna body, and said passive element is provided within said antenna body.

By this structure, the antenna body, and the parallel circuit constituting of the switching element and the passive element, connected in series with the conductor of the antenna body, are integrated into a unitary body as the antenna component, and the frequency adjustment of the antenna device is thus performed in the antenna component only.

Variations in performance of the antenna device is therefore caused less by variations in the mounting conditions of other parts such as resistors and capacitors, the yield of the antenna device is increased, and as a result, the yield of the mobile communication apparatus is accordingly increased.

BRIEF DESCRIPTION OF THE DRAWINGS

FIG. 3 is a graph showing the reflection coefficient and gain of the antenna device of FIG. 2 with the switching element turned on.

FIG. 8 is a graph showing the gain and voltage standing wave ratio of the antenna device of FIG. 6 with the switching element turned on.

FIG. 15 is perspective view showing the conventional antenna device.

PREFERRED EMBODIMENTS OF THE PRESENT INVENTION

Other features and advantages of the present invention will become apparent from the following description of the invention which refers to the accompanying drawings.

Figure 1:
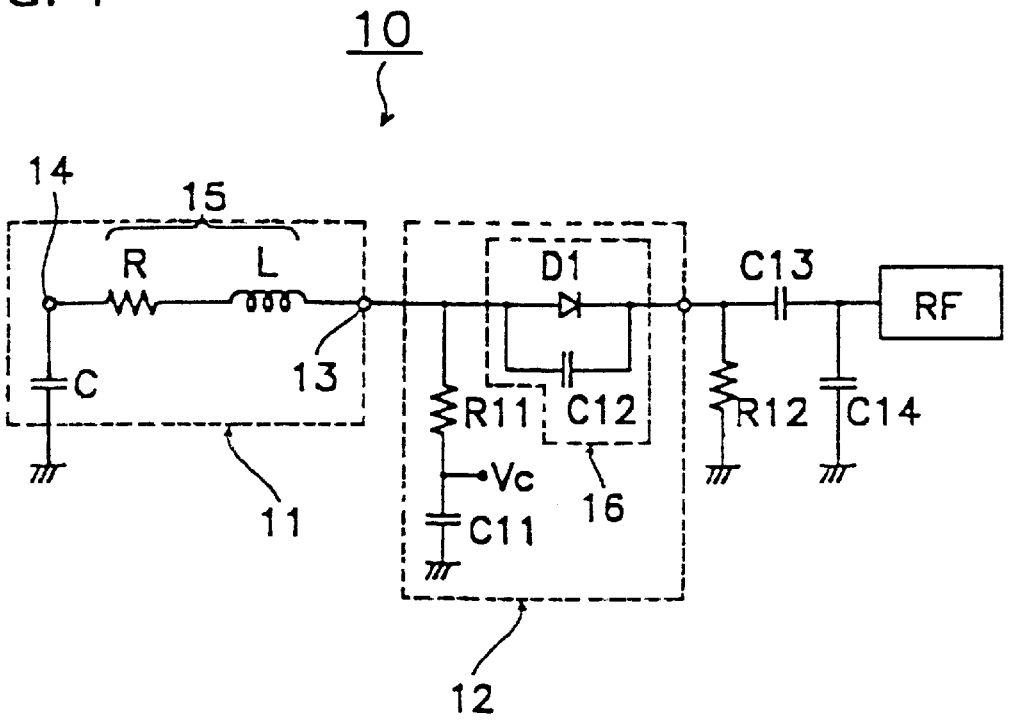
FIG. 1 is a chematic diagram showing the first embodiment of the antenna device of the present invention.

FIG. 1 is a schematic diagram of a first embodiment of the antenna device of the present invention. An antenna device 10 includes an antenna body 11 and a frequency adjusting circuit 12.

The antenna body 11 has an equivalent circuit in which an inductive component L and a resistive component R are connected in series, and a conductor 15 having one end 13 as a feeder end and the other end 14 as a free end.

The frequency adjusting circuit 12 includes a diode D1 as a switching element, capacitors C11, C12, and resistor R11. The anode of the diode D1 is connected to the one end 13 of the antenna body 11 while being grounded via a series circuit of the resistor R11 and capacitor C11, and a control voltage Vc for controlling the diode D1 for on and off operations is coupled to the node of the resistor R11 and the capacitor C11.

The cathode of the diode D1 is connected, via capacitor C13 for adjusting the input impedance of the antenna device 10, to a radio frequency circuit RF of a mobile communication apparatus to which the antenna device 10 is connected, and is also grounded via a capacitor C14. Furthermore, the cathode of the diode D1 is grounded via a resistor R12.

The capacitor C12 as a capacitance element is connected in parallel with the diode D1. The frequency adjusting circuit 12 including a parallel circuit 16 constituting the diode D1 and the capacitor C12 is connected in series with the one end 13 of the conductor 15 of the antenna body 11.

Figure 2:
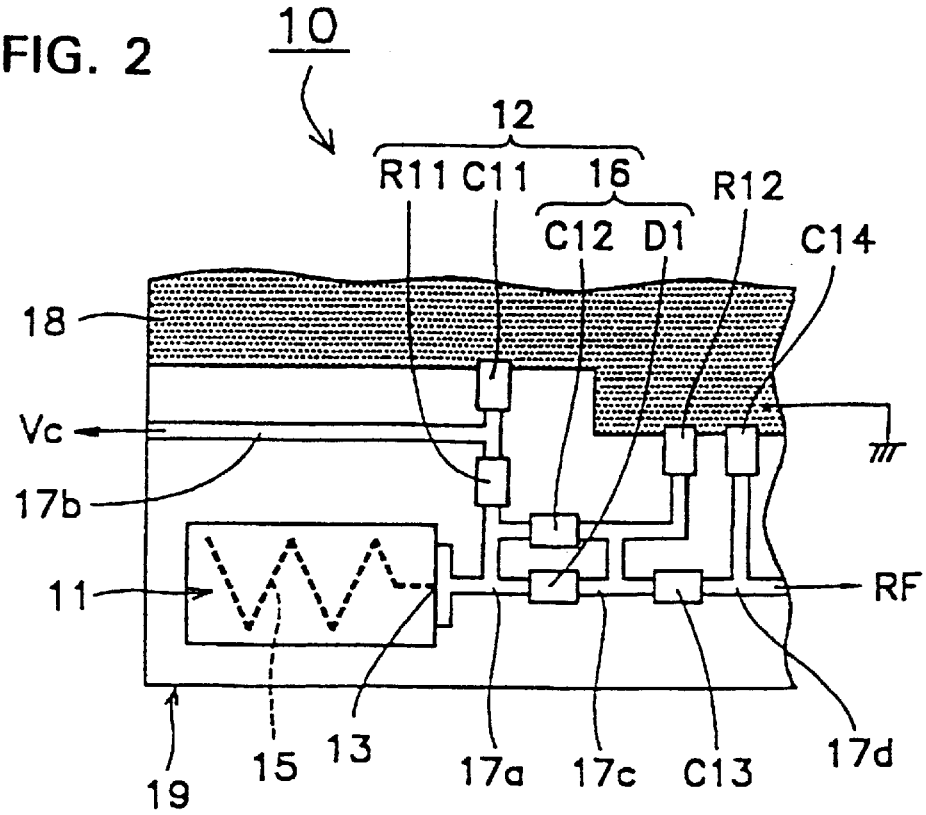
FIG. 2 is a partial top view of the antenna device of FIG. 1.

FIG. 2 is a partial top view of the antenna device 10 of FIG. 1. The antenna device 10 is produced by mounting, on a circuit board 19 having transmission lines 17*a*–17*d* and a ground electrode 18 thereon, the antenna body 11, the frequency adjusting circuit 12 that is constructed of the diode D1, capacitors C11, C12 and resistor R11, and capacitors C13, C14 and resistor R12 for adjusting the input impedance of the antenna device 10.

The one end 13 of the antenna body 11 is connected to the anode of the diode D1 via the transmission line 17*a* while being connected to the ground electrode 18 via the transmission line 17*a,* resistor R11, transmission line 17*b* and capacitor C11.

The cathode of the diode D1 is connected to the radio frequency circuit RF via the transmission line 17*c*, capacitor C13, and transmission line 17*d* while being connected to the ground electrode 18 via the transmission line 17*c,* capacitor C13, transmission line 17*d* and capacitor C14. The cathode of the diode D1 is also connected to the ground electrode 18 via the transmission line 17*c* and resistor R12. The capacitor C12 is connected in parallel with the diode D1 via the transmission lines 17*a* and 17*c*.

Figure 3:
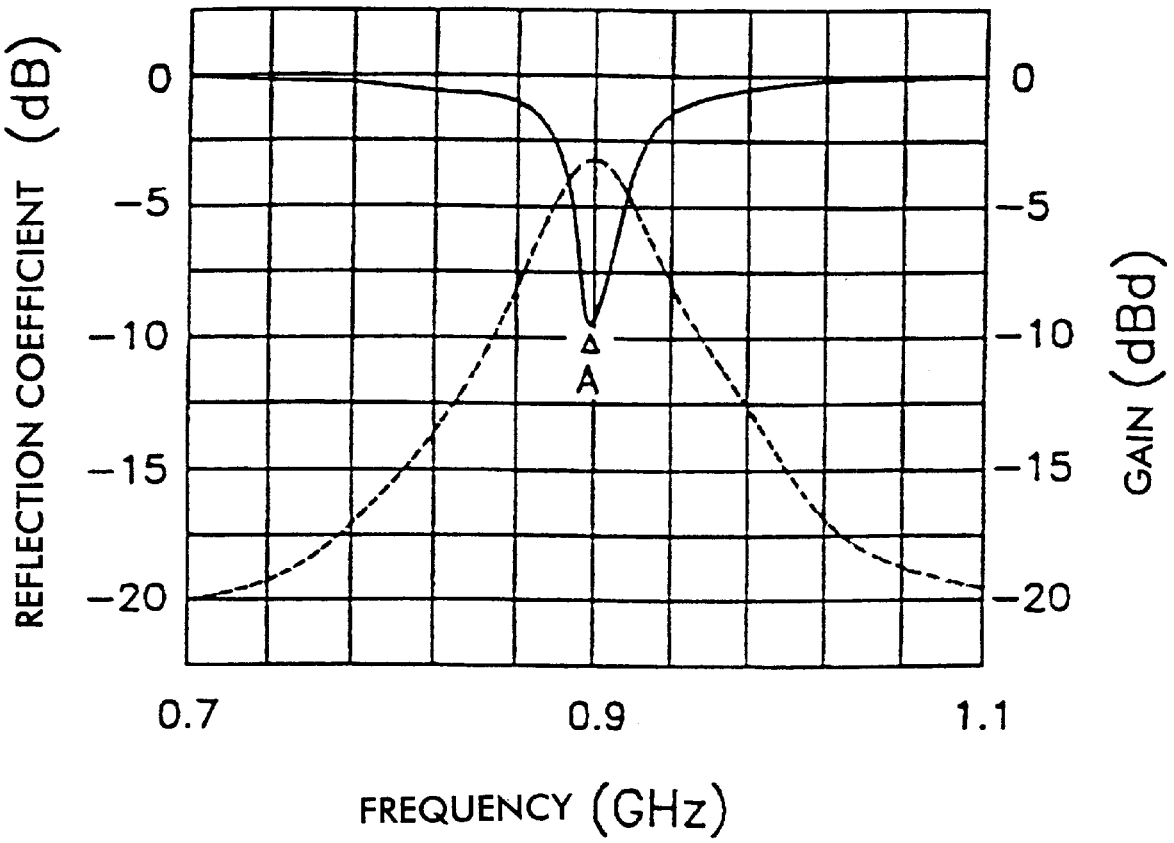
Figure 4:
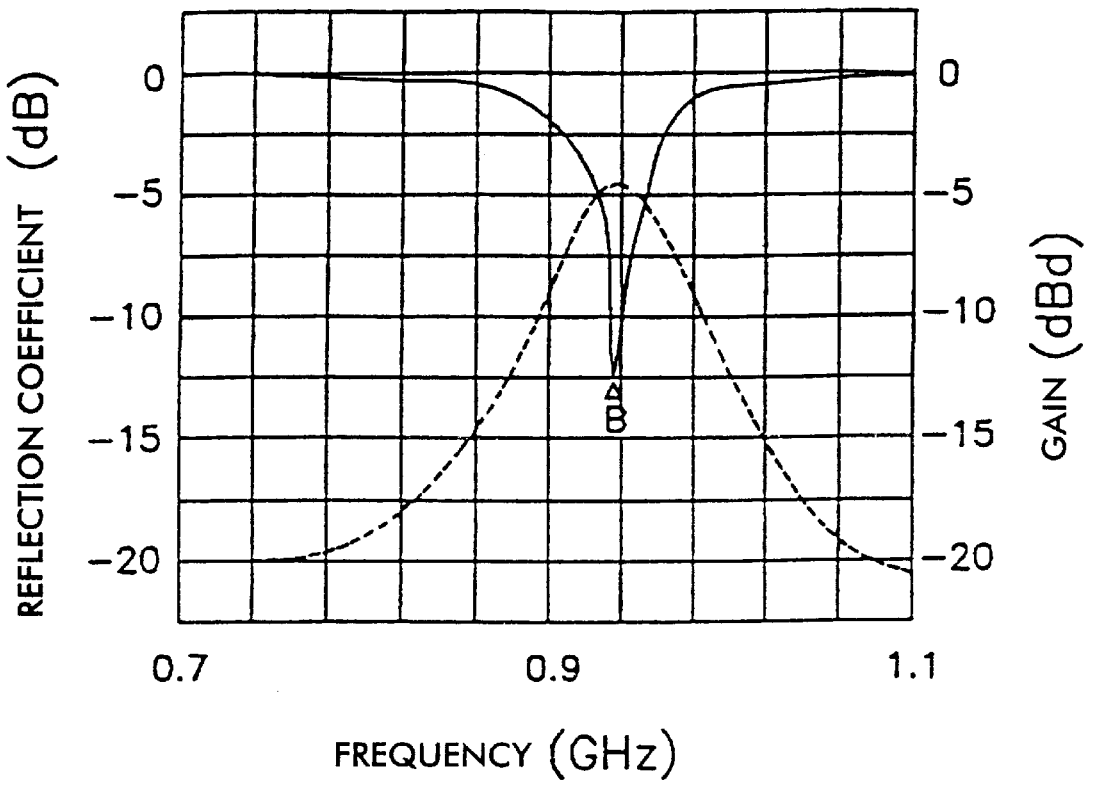
FIG. 4 is a graph showing the reflection coefficient and gain of the antenna device of FIG. 2 with the switching element turned off.

FIG. 3 shows the reflection coefficient and gain of the antenna device 10 shown in FIG. 2 with the diode D1 turned on, and FIG. 4 shows the reflection coefficient and gain of the antenna device 10 shown in FIG. 2 with the diode D1 turned off. Referring to FIGS. 3 and 4, full lines represent the reflection coefficient and broken lines represent the gain, and points A and B (marks Δ in FIGS. 3 and 4) show resonant frequencies in respective cases (with the diode D1 turned on and off). The capacitance values of capacitors C11, C12, C13 and C14 are 1000 pF, 1 pF, 1000 pF and 2 pF, respectively and the resistance values of the resistors R11 are 1.5 kS and 1.5 kS, respectively.

As seen from FIG. 3, with the diode D1 turned on, the resonant frequency of the antenna device 10 is 901.5 MHz (point A) with its gain at −3 dBd, and as seen from FIG. 4, with the diode D1 turned off, the resonant frequency of the antenna device 10 is 940 MHz (point B) with its gain at −4 dBd.

The above is discussed further using equations. With the diode D1 turned on, the impedance of the diode D1 becomes "zero", and the resonant frequency f1on is $$f1on = \frac{1}{2\pi\sqrt{L0 \cdot \frac{C0 \cdot C2}{C0 + C2}}} \quad \text{[Equation 1]}$$

as above.

With the diode D1 turned off, the impedance of the diode D1 becomes "infinite", and the resonant frequency f1off is $$f1off = \frac{1}{2\pi\sqrt{L0 \cdot \frac{C0 \cdot C1 \cdot C2}{C0 \cdot C1 + C1 \cdot C2 + C2 \cdot C0}}} \quad \text{[Equation 2]}$$

as above.

In the above equations, L0 represents the inductance value of the inductive component L of the conductor 15, C0 represents the capacitance value of stray capacity C generated between the free end 14 of the conductor 15 and ground, C1 represents the capacitance value of the capacitor C12 constituting the parallel circuit 16, and C2 represents the overall capacitance value of the capacitors C13 and C14 for adjusting the input impedance of the antenna device 10.

If the resonant frequencies with the diode D1 turned on and with the diode D1 turned off are compared with each other, the resonant frequency f1on with the diode D1 turned on becomes lower.

Since in the antenna device of the first embodiment, the frequency adjusting circuit including the parallel circuit constituting the diode and the capacitor is connected in series with the antenna body, the capacitive component of the antenna device is changed by turning on or off the diode.

The resonant frequency of the antenna device is thus changed without changing the gain of the antenna device. More particularly, the resonant frequency with the diode turned on is set to be lower and the resonant frequency with the diode turned off is set to be higher. As a result, even the antenna device itself has a narrow bandwidth, it works in a wide range of frequency, and can thus be used in the mobile communication apparatus performing transmission and reception on frequencies in a wide range.

Since the antenna body and the parallel circuit constituting the diode and the capacitor are mounted on the circuit board, a compact design is implemented in the antenna device. The antenna device can thus be mounted on a portable mobile communication apparatus performing transmission and reception on frequencies in a wide range.

The compactly designed antenna device allows itself to be housed in the apparatus body of the mobile communication apparatus, thereby eliminating any projections from the mobile communication apparatus.

Since the capacitors (C11) for adjusting the input impedance of the antenna device are connected in series with the parallel circuit constituting the diode and the capacitor, the input impedance of the antenna device is adjusted by adjusting the capacitance value of these capacitors even if the turning on and off the diode deviates the input impedance of the antenna device off the characteristic impedance of the radio frequency circuit of the mobile communication apparatus to which the antenna device is mounted.

Since the frequency adjusting circuit is connected to the one end of the conductor of the antenna body, the one end of the conductor of the antenna body is grounded through the capacitors for adjusting the input impedance of the antenna device, and the other end of the antenna body is left open, and the antenna device has thus a structure equivalent to a monopole antenna. The antenna device has a widened bandwidth, and works in a wider frequency range, and is thus used in the mobile communication apparatus performing transmission and reception on frequencies in a wider range.

Figure 5:
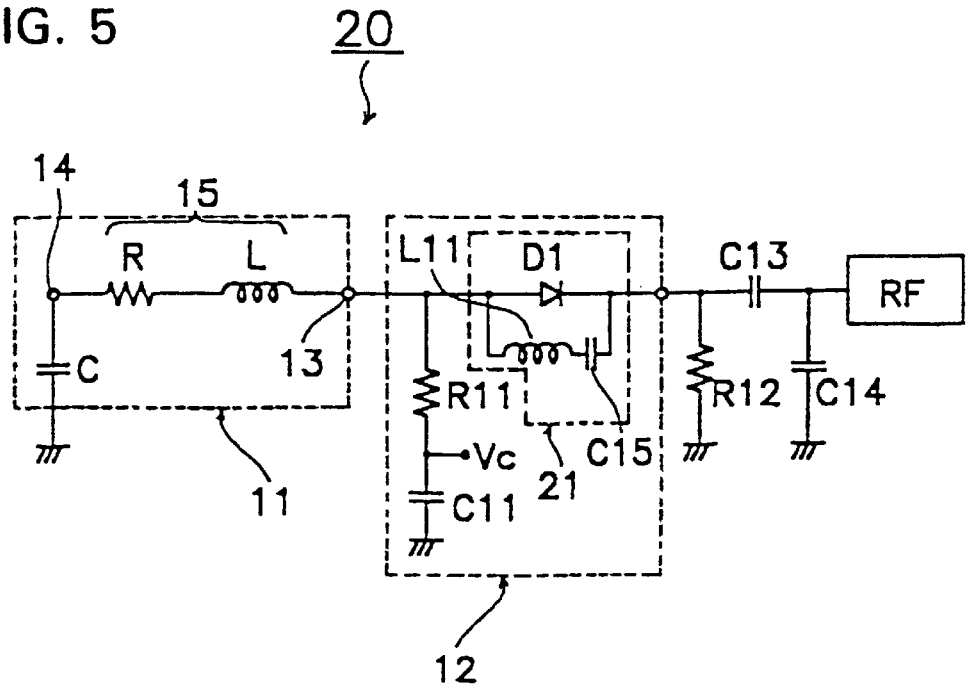
FIG. 5 is a schematic diagram showing the second embodiment of the antenna device of the present invention.

FIG. 5 is a schematic diagram showing a second embodiment of the antenna device of the present invention. An antenna device 20 is different from the antenna device 10 of the first embodiment (FIG. 1) in that a parallel circuit 21 constituting a frequency adjusting circuit 12 includes a diode D1 as a switching element and an inductor L11 as an inductance element. A capacitor C15 for blocking a direct current is connected in series with the inductor L11.

The change in the resonant frequency f2 of the antenna device 20 is now discussed using equation. With the diode D1 turned on, the impedance of the diode D1 becomes "zero", and the resonant frequency f2on is $$f2on = \frac{1}{2\pi\sqrt{L0 \cdot \frac{C0 \cdot C2}{C0 + C2}}} \quad \text{[Equation 3]}$$

as above.

With the diode D1 turned off, the impedance of the diode D1 becomes "infinite", and the resonant frequency f2off is $$f2off = \frac{1}{2\pi\sqrt{(L0 + L1) \cdot \frac{C0 \cdot C1 \cdot C2}{C0 \cdot C1 + C1 \cdot C2 + C2 \cdot C0}}} \quad \text{[Equation 4]}$$

as above.

In the above equations, L0 represents the inductance value of the inductive component L of the conductor 15, L1 represents the inductance value of the inductor L11 constituting the parallel circuit 21, C0 represents the capacitance value of stray capacity C generated between the free end 14 of the conductor 15 and ground, C1 represents the capacitance value of the capacitor C15 constituting the parallel circuit 21, and C2 represents the overall capacitance value of the capacitors C13 and C14 for adjusting the input impedance of the antenna device 10. Because the capacitor C15 is intended to block a direct current, its capacitance value C1 is very large. The inductance value L1 of the inductor L11, therefore, affects more the resonant frequency than the capacitance value C1 of the capacitor C15.

If the resonant frequencies with the diode D1 turned on and with the diode D1 turned off are compared with each other, the resonant frequency f2on with the diode D1 turned on becomes higher.

Since in the antenna device of the second embodiment, the frequency adjusting circuit including the parallel circuit constituting the diode and the inductor is connected in series with the antenna body, the inductive component of the antenna device is changed by turning on or off the diode.

The resonant frequency of the antenna device is thus changed without changing the gain of the antenna device. More particularly, the resonant frequency with the diode turned on is set to be higher and the resonant frequency with the diode turned off is set to be lower.

Figure 6:
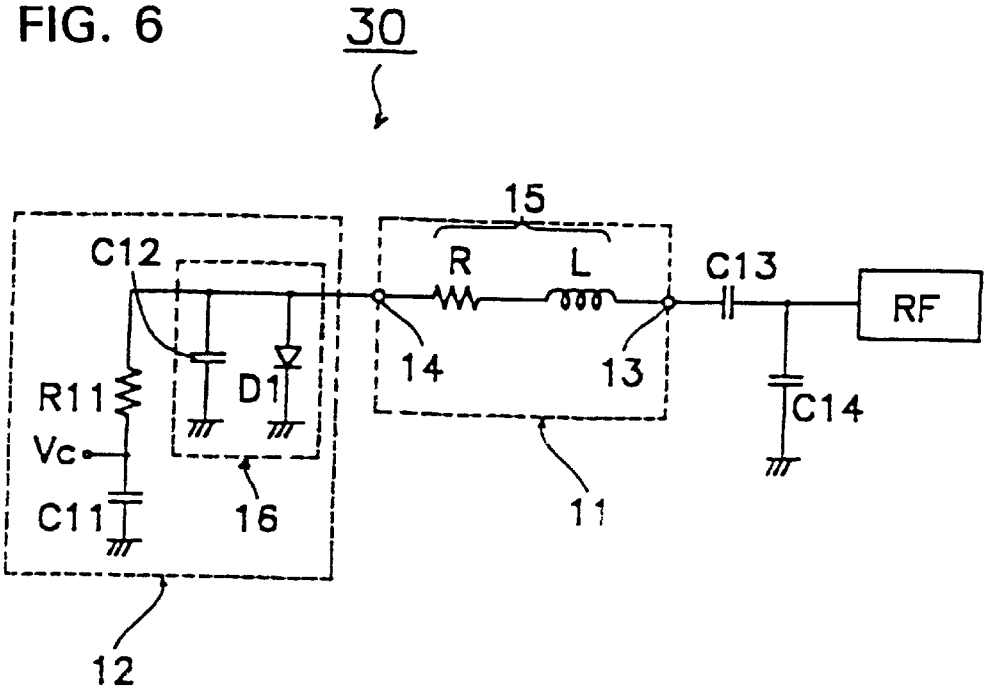
FIG. 6 is a schematic diagram showing the third embodiment of the antenna device of the present invention.

FIG. 6 is a schematic diagram of a third embodiment of the antenna device of the present invention. The antenna device 30 is different from the antenna device 10 of the first embodiment (FIG. 1) in that the frequency adjusting circuit 12 is connected to the other end 14 of the conductor 15 of the antenna body 11.

Figure 7:
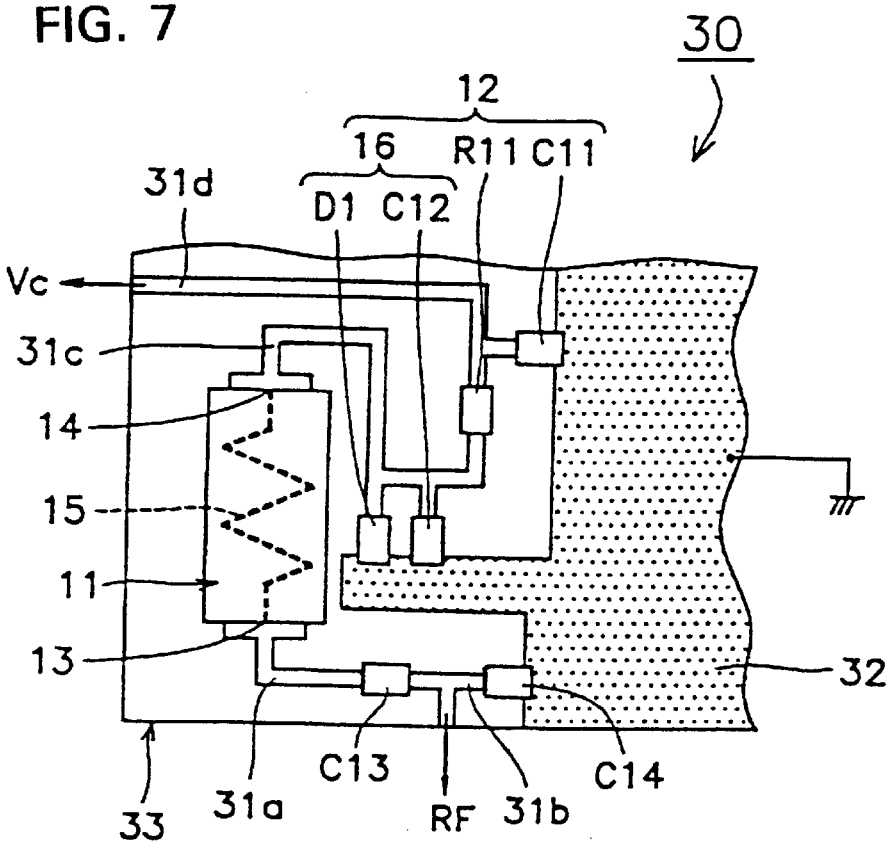
FIG. 7 is a partial top view showing the antenna device of FIG. 6.

FIG. 7 is a partial top view of the antenna device 30 of FIG. 6. The antenna device 30 is produced by mounting, on a circuit board 33 having transmission lines 31*a*–31*d* and a ground electrode 32 thereon, the antenna body 11, the frequency adjusting circuit 12 that is constructed of the diode D1, capacitors C11, C12 and resistor R11, and capacitors C13 and C14 for adjusting the input impedance of the antenna device 30.

One end 13 of the antenna body 11 is connected to the transmission line 31*b* via the transmission line 31*a* and the capacitor C13. The transmission line 31*b* is connected to the radio frequency circuit RF while being connected to the ground electrode 32 via the capacitor C14.

The other end 14 of the antenna body 11 is connected to the transmission line 31*c*. The transmission line 31*c* is connected to the ground electrode 32 via the diode D1 while being connected to a ground electrode 21 via the resistor R11, transmission line 31*d*, and capacitor C11. The capacitor C12 is connected in parallel with the diode D1 via the transmission lines 31*c* and the ground electrode 32.

Figure 8:
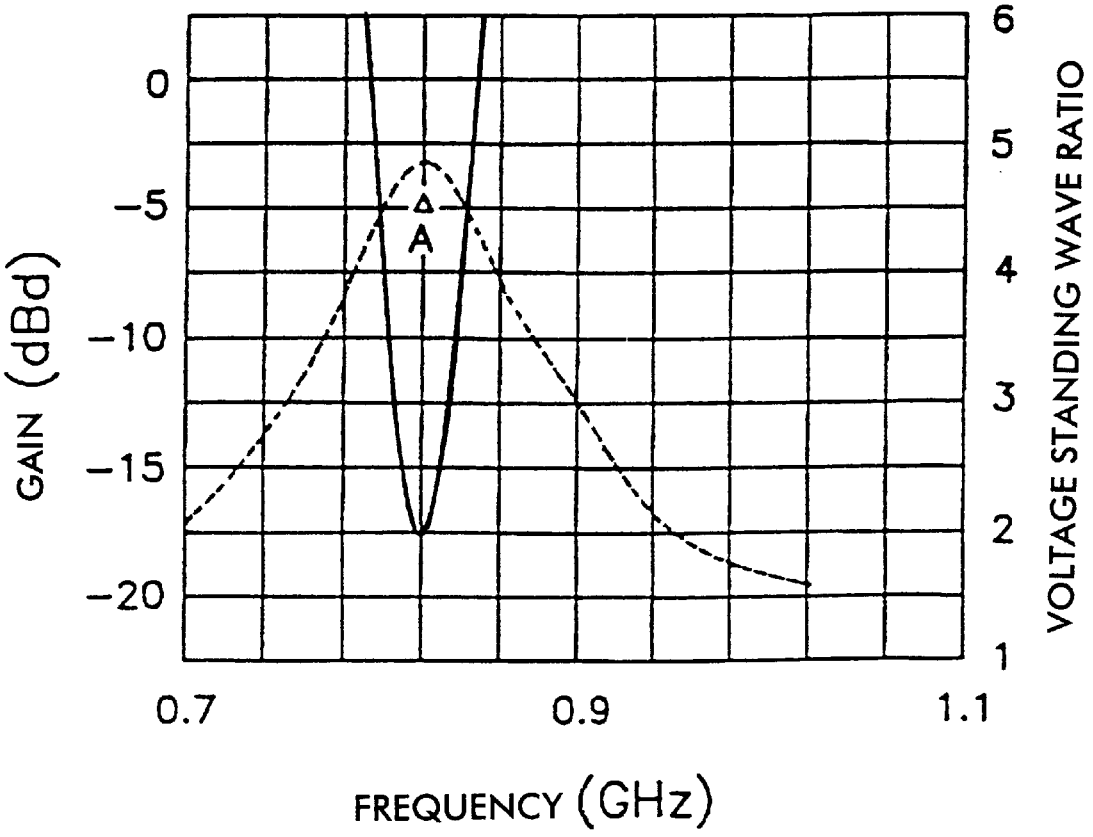
Figure 9:
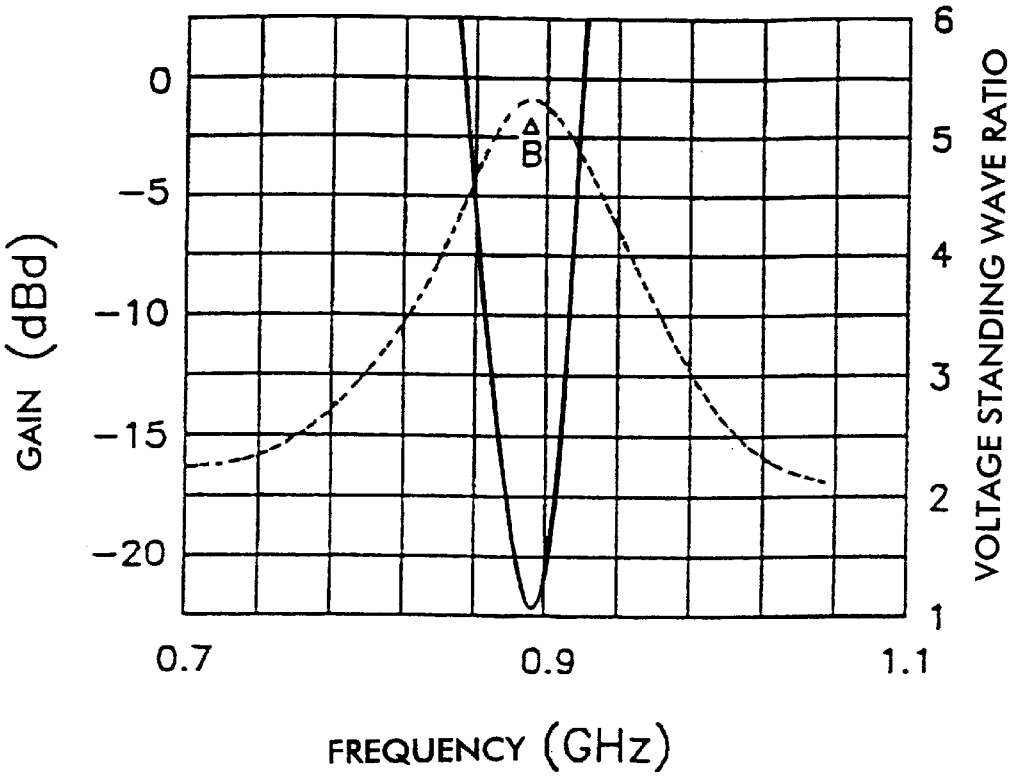
FIG. 9 is a graph showing the gain and voltage standing wave ratio of the antenna device of FIG. 6 with the switching element turned off.

FIG. 8 shows the gain and voltage standing wave ratio of the antenna device 30 shown in FIG. 7 with the diode D1 turned on, and FIG. 9 shows the gain and voltage standing wave ratio of the antenna device 30 shown in FIG. 7 with the diode D1 turned off. Referring to FIGS. 8 and 9, full lines represent the voltage standing wave ratio and broken lines represent the gain, and points A and B (marks Δ in FIGS. 8 and 9) show resonant frequencies in respective cases (with the diode D1 turned on and off). The capacitance values of capacitors C11, C12, C13 and C14 are 1000 pF, 3 pF, 0.3 pF and 2.5 pF, respectively and the resistance value of the resistor R1 is 3 kS.

As seen from FIG. 8, with the diode D1 turned on, the resonant frequency of the antenna device 10 is 819 MHz (point A) with its voltage standing wave ratio at resonance at approximately 2 and its gain at −3 dBd, and as seen from FIG. 9, with the diode D1 turned off, the resonant frequency of the antenna device 10 is 889 MHz (point B) with its voltage standing wave ratio at approximately 1 and its gain at −1 dBd.

The above operation is now discussed using equations. With the diode D1 turned on, the impedance of the diode D1 becomes "zero", and the resonant frequency f3on is $$f3on = \frac{1}{2\pi\sqrt{L0 \cdot C2}} \qquad \text{[Equation 5]}$$

as above.

With the diode D1 turned off, the impedance of the diode D1 becomes "infinite", and the resonant frequency f3off is $$f3off = \frac{1}{2\pi\sqrt{L0 \cdot \frac{C1 \cdot C2}{C1 + C2}}} \qquad \text{[Equation 6]}$$

as above.

In the above equations, L0 represents the inductance value of the inductive component L of the conductor 15, C1 represents the capacitance value of the capacitor C12 constituting the parallel circuit 16, and C2 represents the overall capacitance value of the capacitors C13 and C14 for adjusting the input impedance of the antenna device 10.

If the resonant frequencies with the diode D1 turned on and with the diode D1 turned off are compared with each other, the resonant frequency f3on with the diode D1 turned on becomes lower.

Since in the antenna device of the third embodiment, the frequency adjusting circuit including the parallel circuit constituting the diode and the capacitor is connected in series with the antenna body, the capacitive component of the antenna device is changed by turning on or off the diode.

The resonant frequency of the antenna device is thus changed without changing the gain of the antenna device. More particularly, the resonant frequency with the diode turned on is set to be lower and the resonant frequency with the diode turned off is set to be higher. As a result, even the antenna device itself has a narrow bandwidth, it works in a wide range of frequency, and is thus used in the mobile communication apparatus performing transmission and reception on frequencies in a wide range.

Since the antenna body and the parallel circuit constituting the diode and the capacitor are mounted on the circuit board, a compact design is implemented in the antenna device. The antenna device can thus be mounted on a portable mobile communication apparatus performing transmission and reception on frequencies in a wide range.

The compactly designed antenna device allows itself to be housed in the apparatus body of the mobile communication apparatus, thereby eliminating any projections from the mobile communication apparatus.

Since the frequency adjusting circuit is connected to the other end of the conductor of the antenna body, the one end of the conductor of the antenna body is grounded through the capacitors for adjusting the input impedance of the antenna device, and the other end of the antenna body is grounded through the frequency adjusting circuit, and the antenna device has thus a structure equivalent to a loop antenna. The antenna device is therefore affected less by the environment surrounding it, and the antenna characteristics such as gain and directivity are improved.

Figure 10:
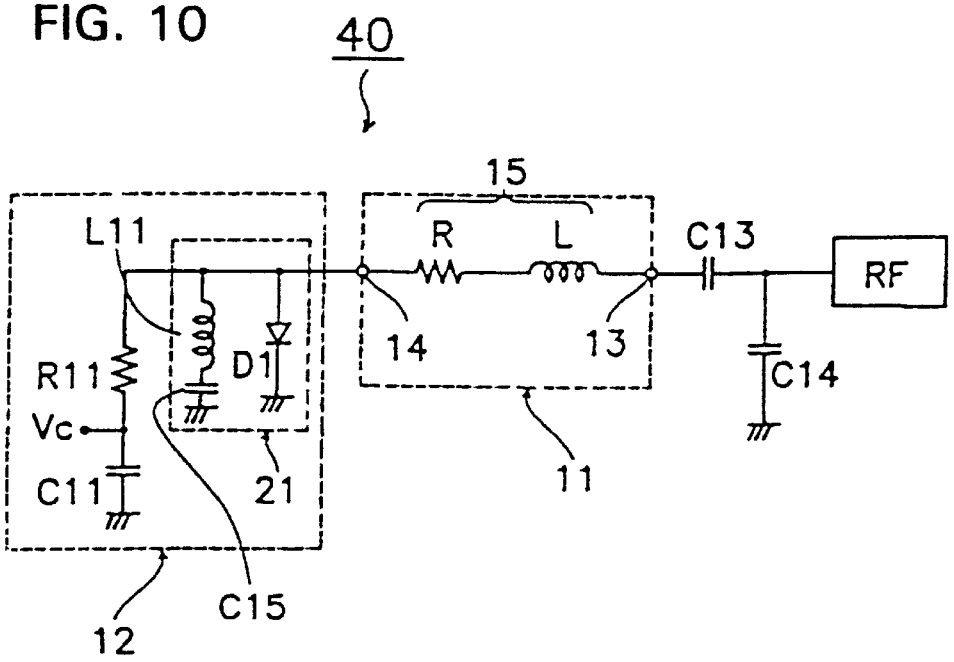
FIG. 10 is a schematic diagram showing the fourth embodiment of the antenna device of the present invention.

FIG. 10 is a schematic diagram showing a fourth embodiment of the antenna device of the present invention. The antenna device 40 is different from the antenna device 30 of the third embodiment (FIG. 6) in that a parallel circuit 21 constituting a frequency adjusting circuit 12 includes a diode D1 as a switching element and an inductor L11 as an inductance element. A capacitor C15 for blocking a direct current is connected in series with the inductor L11.

The change in the resonant frequency f4 of the antenna device 40 is now discussed using equations. With the diode D1 turned on, the impedance of the diode D1 becomes "zero", and the resonant frequency f4on is $$f4on = \frac{1}{2\pi\sqrt{L0 \cdot C2}} \quad \text{[Equation 7]}$$

as above.

With the diode D1 turned off, the impedance of the diode D1 becomes "infinite", and the resonant frequency f4off is $$f4off = \frac{1}{2\pi\sqrt{(L0 + L1) \cdot \frac{C1 \cdot C2}{C1 + C2}}} \quad \text{[Equation 8]}$$

as above.

In the above equations, L0 represents the inductance value of the inductive component L of the conductor 15, L1 represents the inductance value of the inductor L11 constituting the parallel circuit 21, C1 represents the capacitance value of the capacitor C15 constituting the parallel circuit 21, and C2 represents the overall capacitance value of the capacitors C13 and C14 for adjusting the input impedance of the antenna device 10. Because the capacitor C15 is intended to block a current, its capacitance value C1 is very large. The inductance value L1 of the inductor L11, therefore, affects more the resonant frequency than the capacitance value C1 of the capacitor C11.

If the resonant frequencies with the diode D1 turned on and with the diode D1 turned off are compared with each other, the resonant frequency f4on with the diode D1 turned on becomes higher.

Since in the antenna device of the fourth embodiment, the frequency adjusting circuit including the parallel circuit constituting the diode and the inductor is connected in series with the antenna body, the inductive component of the antenna device is changed by turning on or off the diode.

The resonant frequency of the antenna device is thus changed without changing the gain of the antenna device. More particularly, the resonant frequency with the diode turned on is set to be higher and the resonant frequency with the diode turned off is set to be lower.

Figure 11:
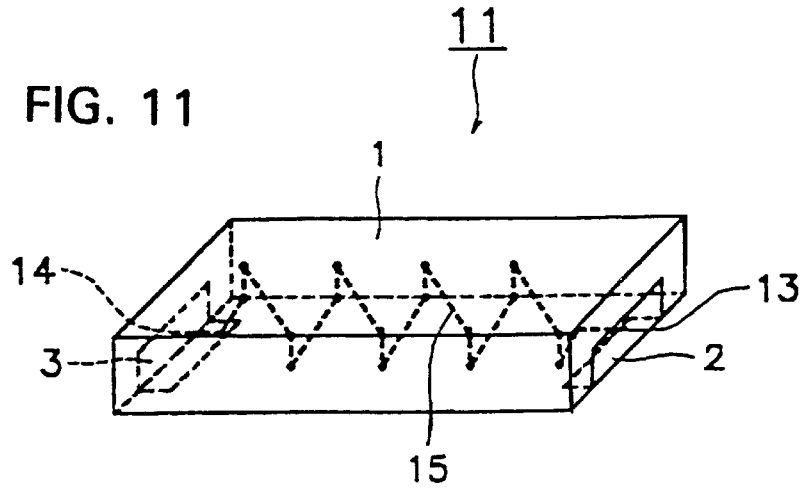
FIG. 11 is a perspective view showing the antenna body constituting the antenna device of FIG. 1.

FIG. 11 is a perspective view of the antenna body 11 constituting the antenna devices 10, 20, 30 and 40. The antenna body 11 includes the conductor 15 spirally coiled in the rectangular parallelopiped base 1 manufactured of barium oxide, aluminum oxide, and silica as its main components, in the direction of length of the base 1, the feeding terminal 2 and the free terminal 3 on the surfaces of the base 1. The one end 13 of the conductor 15 is routed out of the surface of the base 1 and is then connected to the feeding terminal 2 for feeding voltage to the conductor 15. The other end 14 of the conductor 15 is routed out of the surface of the base 1, and is connected to the free terminal 3.

In the antenna body 11 constituting the antenna bodies 10 and 20 in the first and second embodiments, respectively, the other end 14 of the conductor 15 is open, and the free terminal 3 is therefore not required on the surface of the base 1. Alternatively, the other end 14 of the conductor 15 may be left embedded in the base 1 rather than exposed out of the surface of the base 1.

The use of barium oxide, aluminum oxide and silica as main components for the rectangular parallelopiped base slows velocity of propagation, shortening wavelength, and let $\epsilon$ represent dielectric constant of the base, effective transmission line length is multiplied by $\epsilon^{1/2}$, thereby becoming longer than the effective transmission line length of conventional wire-like antenna. The area of current distribution is therefore expanded, increasing quantity of radiated radio wave and enhancing gain of the antenna device.

Figure 12:
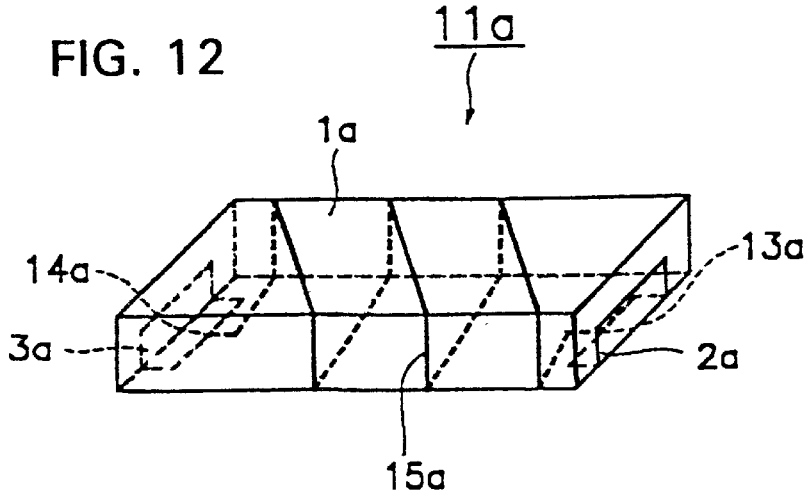
FIG. 12 is a perspective view showing the internal structure of the modification of the antenna body of FIG. 11.
Figure 13:
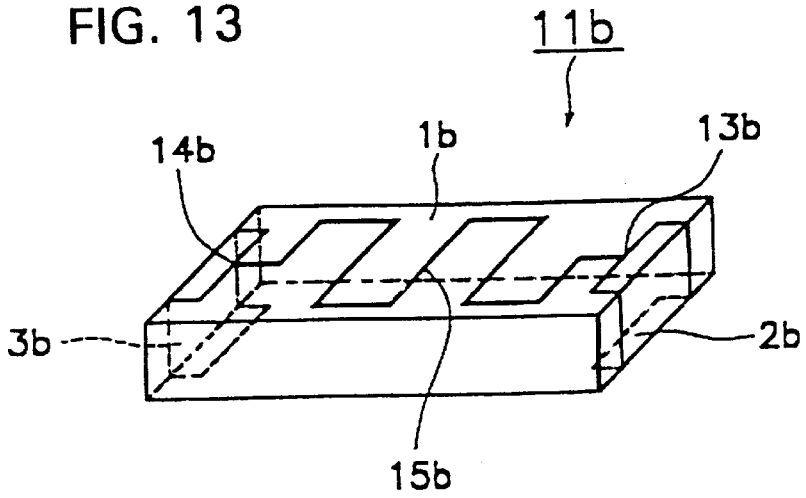
FIG. 13 is a perspective view showing the internal structure of another modification of the antenna body of FIG. 11.

FIG. 12 and FIG. 13 are perspective views of modifications of the first antenna body 11 shown in FIG. 11. The antenna body 11*a* shown in FIG. 12 comprises a rectangular parallelopiped base 1*a,* a conductor 15*a* spirally coiled around the surface of the base 1*a* in the direction of length of the base 1*a,* and a feeding terminal 2*a* and a free terminal 3*a* on the surface of the base 1*a*. One end 13*a* of the conductor 15*a* is connected to the feeding terminal 2*a* for feeding a voltage to the conductor 15*a* on the surface of the base 1*a*. The other end 14*a* of the conductor 15*a* is connected to the free terminal 3*a* on the surface of the base 1*a*. In this case, the conductor 15*a* is easily formed on the base 1*a* through screen printing, and the manufacturing process of the antenna body 11*a* is thus simplified.

The antenna body 11*b* shown in FIG. 13 comprises a rectangular parallelopiped base 1*b,* a meandering conductor 15*b* formed on the surface of the base 1*b,* and a feeding terminal 2*b* and a free terminal 3*b* on the surface of the base 1*b*. One end of the conductor 15*b* is connected to the feeding terminal 2*b* for feeding a voltage to the conductor 15*b* on surface of the base 1*b*. The other end of the conductor 15*b* is connected to the free terminal 3*b* on the surface of the base 1*b*. Since the meandering conductor 15*b* is formed on one principal surface of the base 1*b* only, a low profile design is introduced in the base 1*b,* and the antenna body 11*b* is also low-profiled accordingly. The meandering conductor 15*b* may be formed within the base 1*b*.

Figure 14:
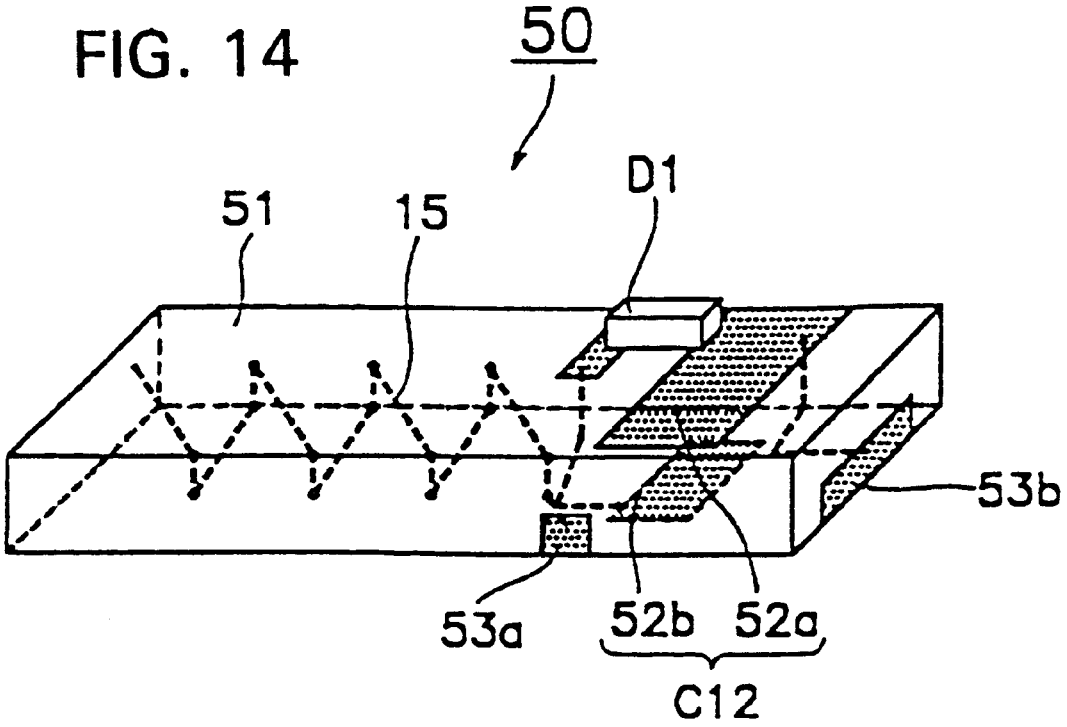
FIG. 14 is a perspective view showing the antenna component constituting the antenna device of FIG. 1.
Figure 14:
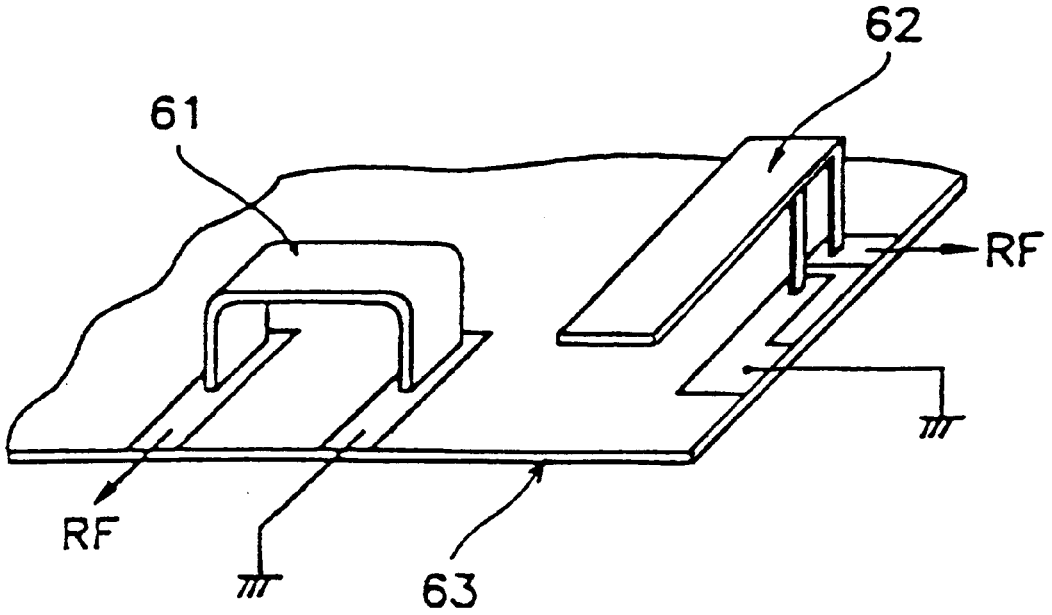

FIG. 14 is a perspective view of an antenna component into which the antenna body 11, and the diode D1 and capacitor C12 constituting the frequency adjusting circuit 12 of the antenna device 10 shown in FIG. 1 are integrated into a unitary body.

The antenna component 50 has capacitor electrodes 52*a* and 52*b* forming the capacitor C12, respectively on the top of and inside a base 51 constituting the antenna body 11, and the diode D1 on top of the base 51.

Internally to the base 51, the anode of the diode D1 is connected to the one end of the conductor 15 of the antenna body 11, to an external terminal 53*a* attached to the side surface of the base 51 and to the capacitor electrode 52*b*. Also internally to the base 51, the cathode of the diode D1 is connected to the capacitor electrode 52*a,* and the capacitor electrode 52*a* is connected to an external terminal 53*b* on the side surface of the base 51. With this arrangement, the parallel circuit 21 constituting the diode D1 and the capacitor C12 is connected in series with the conductor 15 of the antenna body 11.

Although it is not shown, the antenna component 51 is mounted along with the capacitors C11 and resistor R11 constituting the frequency adjusting circuit 12, and the capacitors C13 and C14 for adjusting the input impedance of the antenna device 10, and thus forms the antenna device 10.

Since in this case, the antenna body, and the parallel circuit constituting the diode and the capacitor, connected in series with the conductor of the antenna body, are integrated into the same base as a unitary body to be the antenna component, the frequency adjustment of the antenna device is performed in the antenna component only. Variations in performance of the antenna device is therefore caused less by variations in the mounting conditions of other parts such as resistors and capacitors, the yield of the antenna device is increased, and as a result, the yield of the mobile communication apparatus is accordingly increased.

The antenna body has the conductor spirally coiled internally to or on the surface of the base, and although in the above-embodiment, the antenna body has the meandering conductor on the surface of the base, the configuration of the conductor is not important as long as the equivalent circuit of the conductor of the antenna body is formed of an inductive component and a resistive component.

Although in the above discussion, the base of the antenna body or the base of the antenna component is manufactured of a dielectric material containing barium oxide, aluminum oxide and silica as its main components, the base is not limited to this material, and the base may be manufactured of a dielectric material containing titanium oxide and neodymium oxide as its main components, a magnetic material containing nickel, cobalt, and iron as its main components, or a combination of the dielectric material and the magnetic material.

Although the antenna body or the antenna component has a single conductor in the above discussion, the antenna body or the antenna component may have a plurality of conductors running in parallel. In such a case, the antenna device has a plurality of resonant frequencies corresponding to the number of the conductors, and one single antenna presents a multi-band capability.

Although the diode is used as the switching element in the above discussion, a field-effect transistor or bipolar transistor performs the same function.

In the antenna component in which the antenna body and the parallel circuit constituting the switching element and the passive element are integrated on the same circuit board as a unitary body, the passive element is a capacitance element, but equal performance will be achieved if the passive element is an inductance element.

In the antenna devices 10 and 20 in the first and second embodiments, an RF choke constructed of a coil having a large inductance or a transmission line having a $\lambda/4$ length may be substituted for the resistor R11. In such a case, the impedance of the RF choke may be considered for the adjustment of the input impedance of the antenna device.

In the antenna devices 30 and 40 in the third and fourth embodiments, an RF choke constructed of a coil having a large inductance or a transmission line having a $\lambda/4$ length may be connected in series with the resistor R11. In such a case, the overall impedance of the resistor R11 and the RF choke becomes large, and the effect of resistive component of the radio frequency circuit RF of the mobile communication apparatus to which the antenna device 30 or 40 is connected, over the antenna device 30 or 40, is reduced.

While the invention has been particularly shown and described with reference to preferred embodiments thereof, it will be understood by those skilled man in the art that the forgoing and other changes in form and details may be made therein without departing from the spirit of the invention.

What is claimed is:

1. An antenna device for use in a personal digital cellular communication apparatus, comprising:

an antenna body including a conductor, an equivalent circuit of said conductor comprising an inductive component and a resistive component in a series connection, and a frequency changing circuit including at least a parallel circuit comprising a switching diode and a passive element connected to said conductor of said antenna body.

2. The antenna device according to claim 1, wherein said antenna body is connected in series with said frequency changing circuit.

3. The antenna device according to claim 1, wherein said passive element is a capacitance element.

4. The antenna device according to claim 1, wherein said passive element is an inductance element.

5. The antenna device according to claim 1, wherein said frequency changing circuit is connected in series between said conductor of said antenna body and a high-frequency circuit.

6. The antenna device according to claim 1, wherein said conductor of said antenna body is connected in series between said frequency changing circuit and a high-frequency circuit.

7. The antenna device according to claim 1, wherein another capacitance element for adjusting the input impedance of the antenna device is connected in series with said parallel circuit comprising said switching element and said passive element.

8. The antenna device according to claim 1, wherein the antenna body is a chip antenna which comprises a base made of at least one of a dielectric material and a magnetic material, at least one said conductor formed at least on an external surface of said base or within said base, and a feeding terminal, which is provided on the surface of said base and to which one end of said conductor is connected.

9. The antenna device according to claim 8, wherein said switching diode is mounted on said antenna body, and said passive element is provided within said antenna body.

10. The antenna device according to claim 1, wherein a radio frequency circuit is connected to the antenna device, and a capacitor is connected between the radio frequency circuit and the switching diode so that a signal from the radio frequency circuit and a bias voltage applied to the switching diode is separated.

* * * * *